US007163646B2

(12) United States Patent
Hanada

(10) Patent No.: US 7,163,646 B2
(45) Date of Patent: Jan. 16, 2007

(54) SOLVENT COMPOSITIONS

(75) Inventor: Tsuyoshi Hanada, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 40 days.

(21) Appl. No.: 11/066,295

(22) Filed: Feb. 28, 2005

(65) Prior Publication Data

US 2005/0143276 A1 Jun. 30, 2005

Related U.S. Application Data

(63) Continuation of application No. PCT/JP03/10966, filed on Aug. 28, 2003.

(30) Foreign Application Priority Data

Aug. 29, 2002 (JP) ..... 2002-251132

(51) Int. Cl.
*C23G 5/028* (2006.01)
*C23G 5/032* (2006.01)
*C11D 7/30* (2006.01)

(52) U.S. Cl. ..... 252/364; 510/165; 510/166; 510/175; 510/177; 510/408; 510/410; 510/176; 510/411; 510/412; 510/415; 134/40

(58) Field of Classification Search ..... None
See application file for complete search history.

(56) References Cited

U.S. PATENT DOCUMENTS 5,266,231 A * 11/1993 Robeck et al. ..... 510/177
5,266,232 A * 11/1993 Robeck et al. ..... 510/177
5,531,916 A * 7/1996 Merchant ..... 510/412
5,648,325 A * 7/1997 Kitamura et al. ..... 510/177
6,274,543 B1 8/2001 Milbrath et al.
6,281,185 B1 * 8/2001 Owens et al. ..... 510/411
6,544,595 B1 * 4/2003 Hanada et al. ..... 427/393.5
6,699,829 B1 * 3/2004 Doyel et al. ..... 510/410

FOREIGN PATENT DOCUMENTS

| | | |
|---|---|---|
| JP | 5-186796 | 7/1993 |
| JP | 5-194992 | 8/1993 |
| JP | 6-511490 | 12/1994 |
| JP | 7-166199 | 6/1995 |
| JP | 7-188700 | 7/1995 |
| JP | 8-67897 | 3/1996 |
| JP | 10-324652 | 12/1998 |
| JP | 2000-501777 | 2/2000 |
| JP | 2002-517557 | 6/2002 |
| WO | WO 00/17301 | 3/2000 |
| WO | WO 03/44148 | 5/2003 |

OTHER PUBLICATIONS

Japan Patent Office Machine English Language Translation of JP Publication No. 08-067897 (Dec. 3, 1996).*

* cited by examiner

*Primary Examiner*—Joseph D. Anthony
(74) *Attorney, Agent, or Firm*—Oblon, Spivak, McClelland, Maier & Neustadt, P.C.

(57) ABSTRACT

A solvent composition comprising 1,1,1,2,2,3,3,4,4,5,5,6,6-tridecafluorohexane (R52-13), trans-1,2-dichloroethylene (tDCE) and a $C_{1-3}$ alcohol, wherein the content of R52-13 is from 25.0 to 75.0% (by mass, and the same applies hereinafter), the content of tDCE is from 15.0 to 74.9% and the content of the $C_{1-3}$ alcohol is from 0.1 to 10.0%, to the total amount of R52-13, tDCE and the $C_{1-3}$ alcohol. This solvent composition can remove oils and greases and flux with a high cleaning performance.

12 Claims, No Drawings

SOLVENT COMPOSITIONS

BACKGROUND OF THE INVENTION

1. Field of the Invention

The present invention relates to solvent compositions to be used for removing oils and greases attached to articles such as electronic components such as IC, precision mechanical parts, glass substrates, etc., or soil such as flux or dust on printed boards.

2. Discussion of Background

Heretofore, in the precision mechanical industry, the optical instrument industry, the electrical and electronics industry or the plastics industry, for precision cleaning to remove oil, flux, dust, wax or the like attached during manufacturing processes, a hydrochlorofluorocarbon (hereinafter referred to as HCFC) such as dichloropentafluoropropane (hereinafter referred to as R-225) has been widely employed as a fluorinated solvent which is nonflammable and excellent in chemical and heat stability and which is capable of dissolving oils and greases.

However, there is a problem that the ozone depleting potential of HCFC is not 0, and its production is expected to be abolished in advanced countries by year of 2020. Whereas, 1,1,1,2,2,3,3,4,4,5,5,6,6-tridecafluorohexane (hereinafter sometimes referred to as R52-13) is a fluorinated solvent which has an ozone depleting potential of 0 and which presents little impact to the global environment, but it has a problem that its solvency for oils and greases is low.

Further, an azeotropic mixed solvent composition of 89.2 wt % of R52-13 and 10.8 wt % of methanol (JP-A-7-166199) and an azeotropic mixed solvent composition of 91.1 wt % of R52-13 and 8.9 wt % of ethanol (JP-A-7-166199) are known.

On the other hand, trans-1,2-dichloroethylene (hereinafter sometimes referred to as tDCE) has a high solvency for oils and greases, but it has a problem that its flash point is as low as 4° C.

SUMMARY OF THE INVENTION

The present invention provides a solvent composition comprising R52-13, tDCE and a $C_{1-3}$ alcohol, wherein the content of R52-13 is from 25.0 to 75.0% (by mass, and the same applies hereinafter unless otherwise specified), the content of tDCE is from 15.0 to 74.9% and the content of the $C_{1-3}$ alcohol is from 0.1 to 10.0%, to the total amount of R52-13, tDCE and the $C_{1-3}$ alcohol (hereinafter referred to as composition A).

The present invention provides a solvent composition comprising R52-13, tDCE and methanol, wherein the content of R52-13 is from 30.0 to 60.0%, the content of tDCE is from 34.0 to 66.0% and the content of methanol is from 4.0 to 6.0%, to the total amount of R52-13, tDCE and methanol (hereinafter referred to as composition B).

The present invention provides a solvent composition comprising R52-13, tDCE and ethanol, wherein the content of R52-13 is from 35.0 to 65.0%, the content of tDCE is from 31.5 to 63.5% and the content of ethanol is from 1.5 to 3.5%, to the total amount of R52-13, tDCE and ethanol (hereinafter referred to as composition C).

The present invention provides a solvent composition comprising R52-13, tDCE and 2-propanol, wherein the content of R52-13 is from 33.0 to 63.0%, the content of tDCE is from 36.0 to 66.9% and the content of 2-propanol is from 0.1 to 1.0%, to the total amount of R52-13, tDCE and 2-propanol (hereinafter referred to as composition D).

The present invention provides an azeotropic solvent composition comprising R52-13, tDCE and methanol, wherein the content of R52-13 is 45.6%, the content of tDCE is 49.3% and the content of methanol is 5.1%, to the total amount of R52-13, tDCE and methanol (hereinafter referred to as composition E).

The present invention provides an azeotropic solvent composition comprising R52-13, tDCE and ethanol, wherein the content of R52-13 is 47.5%, the content of tDCE is 49.9% and the content of ethanol is 2.6%, to the total amount of R52-13, tDCE and ethanol (hereinafter referred to as composition F).

The present invention provides an azeotropic solvent composition comprising R52-13, tDCE and 2-propanol, wherein the content of R52-13 is 47.7%, the content of tDCE is 51.8% and the content of 2-propanol is 0.5%, to the total amount of R52-13, tDCE and 2-propanol (hereinafter referred to as composition G).

DETAILED DESCRIPTION OF THE PREFERRED EMBODIMENTS

Composition A has a flash point higher than room temperature (25° C.), or has a nonflammable composition which does not ignite even at a boiling point. Further, composition A has a high solvency to oils and greases or fluxes.

As the $C_{1-3}$ alcohol in composition A, methanol, ethanol, 1-propanol or 2-propanol may, for example, be mentioned.

As composition A, particularly preferred is a solvent composition comprising from 30.0 to 70.0% of R52-13, from 20.0 to 69.9% of tDCE and from 0.1 to 10.0% of a $C_{1-3}$ alcohol, to the total amount of R52-13, tDCE and the $C_{1-3}$ alcohol.

Compositions E, F and G are azeotropic solvent compositions. An azeotropic solvent composition is a composition which undergoes no compositional change even if it is vaporized and condensed repeatedly.

Further, compositions B, C and D are azeotrope-like solvent compositions. An azeotrope-like solvent composition is a composition which undergoes little compositional change even if it is vaporized and condensed repeatedly and which thus can be employed practically in the same manner as an azeotropic solvent composition. Such a composition is generally called as an azeotrope-like solvent composition.

In a case where composition B, C, D, E, F or G is used for cleaning of articles, the compositional change is either little or none, and thus, it can be used while maintaining the stable cleaning performance. Further, cleaning can be carried out by employing the same equipment as used for R225 which has heretofore been employed, such being advantageous in that there is no need for substantially changing the conventional technology.

Compositions A to G are preferably constituted solely by R52-13, tDCE and a $C_{1-3}$ alcohol (in compositions B to G, a specific alcohol as specified above), but they may contain other compounds. Here, in the case of compositions B, C and D, they may, respectively, contain other compounds within a range where the nature of the azeotrope-like solvent compositions can be substantially maintained, and in the case of compositions E, F and G, they may, respectively, contain other compounds within a range where the nature of the azeotropic solvent compositions can be substantially maintained.

As such other compounds, at least one component selected from the group consisting of hydrocarbons, alcohols (except a $C_{1-3}$ alcohol), ketones, halogenated hydrocarbons, ethers, esters and glycol ethers, may be mentioned. The content of such other compounds in the solvent composition is preferably at most 20 mass %, more preferably at most 10 mass %. The lower limit of the content of other compounds is the minimum amount where the purpose of adding the compounds can be attained. Usually, the minimum amount is at least 0.1 mass % to the total amount of the solvent composition. In a case where the solvent composition containing other compounds may have an azeotropic composition, it is preferred to use one having such an azeotropic composition.

As the hydrocarbons, $C_{5-15}$ linear or cyclic, saturated or unsaturated hydrocarbons are preferred, and n-pentane, 2-methylbutane, n-hexane, 2-methylpentane, 2,2-dimethylbutane, 2,3-dimethylbutane, n-heptane, 2-methylhexane, 3-methylhexane, 2,4-dimethylpentane, n-octane, 2-methylheptane, 3-methylheptane, 4-methylheptane, 2,2-dimethylhexane, 2,5-dimethylhexane, 3,3-dimethylhexane, 2-methyl-3-ethylpentane, 3-methyl-3-ethylpentane, 2,3,3-trimethylpentane, 2,3,4-trimethylpentane, 2,2,3-trimethylpentane, 2-methylheptane, 2,2,4-trimethylpentane, n-nonane, 2,2,5-trimethylhexane, n-decane, n-dodecane, cyclopentane, methylcyclopentane, cyclohexane, methylcyclohexane, ethylcyclohexane, bicyclohexane, decalin, tetralin or amyl naphthalene may, for example, be mentioned. More preferred is a $C_{5-7}$ hydrocarbon such as n-pentane, cyclopentane, n-hexane, cyclohexane or n-heptane.

As the alcohols, $C_{4-16}$ linear or cyclic, saturated or unsaturated alcohols are preferred, and n-butanol, sec-butanol, isobutanol, tert-butanol, 1-pentanol, 2-pentanol, 1-ethyl-1-propanol, 2-methyl-1-butanol, 3-methyl-1-butanol, 3-methyl-2-butanol, neopentyl alcohol, 1-hexanol, 2-methyl-1-pentanol, 4-methyl-2-pentanol, 2-ethyl-1-butanol, 1-heptanol, 2-heptanol, 3-heptanol, 1-octanol, 2-octanol, 2-ethyl-1-hexanol, 1-nonanol, 3,5,5-trimethyl-1-hexanol, 1-decanol, 1-undecanol, 1-dodecanol, cyclohexanol, 1-methylcyclohexanol, 2-methylcyclohexanol, 3-methylcyclohexanol, 4-methylcyclohexanol, α-terpineol, 2,6-dimethyl-4-heptanol, nonyl alcohol or tetradecyl alcohol may, for example, be mentioned. More preferred is a $C_{4-5}$ alkanol such as n-butanol.

As the ketones, $C_{3-9}$ linear or cyclic ketones are preferred. Specifically, acetone, methyl ethyl ketone, 2-pentanone, 3-pentanone, 2-hexanone, methyl isobutyl ketone, 2-heptanone, 3-heptanone, 4-heptanone, diisobutyl ketone, mesityl oxide, phorone, 2-octanone, cyclohexanone, methylcyclohexanone, isophorone, 2,4-pentanedione or 2,5-hexanedione may, for example, be mentioned. More preferred is a $C_{3-4}$ ketone such as acetone or methyl ethyl ketone.

As the halogenated hydrocarbons, $C_{1-6}$ chlorinated or chlorofluorinated hydrocarbons are preferred, and methylene chloride, 1,1-dichloroethane, 1,2-dichloroethane, 1,1,2-trichloroethane, 1,1,1,2-tetrachloroethane, 1,1,2,2-tetrachloroethane, pentachloroethane, 1,1-dichloroethylene, cis-1,2-dichloroethylene, trichloroethylene, tetrachloroethylene, 1,2-dichloropropane, dichloropentafluoropropane, dichlorofluoroethane or decafluoropentane may, for example, be mentioned. More preferred is a $C_{1-2}$ chlorinated hydrocarbon such as methylene chloride, trichloroethylene or tetrachloroethylene.

As the ethers, $C_{2-8}$ linear or cyclic ethers are preferred, and diethyl ether, dipropyl ether, diisopropyl ether, dibutyl ether, anisole, phenetole, methyl anisole, dioxane, furan, methylfuran or tetrahydrofuran may, for example, be mentioned. More preferred is a $C_{4-6}$ ether such as diethyl ether, diisopropyl ether, dioxane or tetrahydrofuran.

As the esters, $C_{2-19}$ linear or cyclic esters are preferred. Specifically, methyl formate, ethyl formate, propyl formate, butyl formate, isobutyl formate, pentyl formate, methyl acetate, ethyl acetate, propyl acetate, isopropyl acetate, butyl acetate, isobutyl acetate, sec-butyl acetate, pentyl acetate, methoxybutyl acetate, sec-hexyl acetate, 2-ethylbutyl acetate, 2-ethylhexyl acetate, cyclohexyl acetate, benzyl acetate, methyl propionate, ethyl propionate, butyl propionate, methyl butyrate, ethyl butyrate, butyl butyrate, isobutyl isobutyrate, ethyl 2-hydroxy-2-methyl propionate, methyl benzoate, ethyl benzoate, propyl benzoate, butyl benzoate, benzyl benzoate, γ-butyrolactone, diethyl oxalate, dibutyl oxalate, dipentyl oxalate, diethyl malonate, dimethyl maleate, diethyl maleate, dibutyl maleate, dibutyl tartrate, tributyl citrate, dibutyl sebacate, dimethyl phthalate, diethyl phthalate or dibutyl phthalate may, for example, be mentioned. More preferred is a $C_{3-4}$ ester such as methyl acetate or ethyl acetate.

The glycol ethers are compounds having a hydrogen atom of one or both of hydroxyl groups of a dimer to tetramer of a $C_{2-4}$ dihydric alcohol substituted by a $C_{1-6}$ alkyl group. Alkyl ethers of diethylene glycol and alkyl ethers of dipropylene glycol, are preferred. Specifically, a diethylene glycol ether such as diethylene glycol monomethyl ether, diethylene glycol monoethyl ether, diethylene glycol mononormalpropyl ether, diethylene glycol monoisopropyl ether, diethylene glycol mononormalbutyl ether, diethylene glycol monoisobutyl ether, diethylene glycol dimethyl ether, diethylene glycol diethyl ether or diethylene glycol dibutyl ether, a dipropylene glycol ether such as dipropylene glycol monomethyl ether, dipropylene glycol monoethyl ether, dipropylene glycol mononormalpropyl ether, dipropylene glycol monoisopropyl ether, dipropylene glycol mononormalbutyl ether or dipropylene glycol monoisobutyl ether, may, for example, be mentioned.

Further, primarily in order to increase the stability, one or more of the following compounds may, for example, be incorporated to compositions A to G within a range of from 0.001 to 5 mass %. In this regard, such compounds may be incorporated to composition B, C or D within a range where the nature of the azeotrope-like solvent composition can be substantially maintained, and the compounds may be incorporated to composition E, F or G within a range where the nature of the azeotropic solvent composition can be substantially maintained.

The compounds may, for example, be a nitro compound such as nitromethane, nitroethane, nitropropane or nitrobenzene; an amine such as diethylamine, triethylamine, isopropylamine or n-butylamine; a phenol such as phenol, o-cresol, m-cresol, p-cresol, thymol, p-t-butylphenol, t-butyl catechol, catechol, isoeugenol, o-methoxyphenol, bisphenol A, isoamyl salicylate, benzyl salicylate, methyl salicylate or 2,6-di-t-butyl-p-cresol; and a triazole such as 2-(2'-hydroxy-5'-methylphenyl) benzotriazole, 2-(2'-hydroxy-3'-t-butyl-5'-methylphenyl)-5-chlorobenzotriazole, 1,2,3-benzotriazole or 1-[(N,N-bis-2-ethylhexyl)aminomethyl]benzotriazole.

Compositions A to G may preferably be used for various applications in the same manner as conventional R-225 compositions. As a specific application, there may, for example, be an application as a cleaning agent for removing soil attached to articles, a carrier solvent for various compounds to be applied to articles, a dewatering agent or an extractant. The material of the articles may, for example, be glass, ceramics, plastic, elastomer or metal. Further, specific examples of the articles may be electronic/electric instruments, precision mechanical parts, optical instruments, or their components, such as ICs, micromotors, relays, bearings, optical lenses, printed boards or glass substrates.

The soil attached to such an article may, for example, be one which is used at the time of producing the article or a component of the article, and which has to be removed ultimately, or soil which attaches to the article during the use of the article. The material constituting such soil may, for example, be oils and greases, such as greases, mineral oils, waxes or oil-based inks, fluxes, or dust.

A specific method for removing the soil, may, for example, be manual cleaning, dip cleaning, spray cleaning, oscillating cleaning, ultrasonic cleaning or vapor cleaning. Further, a method having such methods combined, may be adopted.

The solvency for soil, etc., may be adjusted by changing the compositional ratio of composition A, B, C or D.

EXAMPLES

Examples 1 to 5, 7 to 11, 13 to 17, 19 to 23, 25 to 29, 31 to 35, 37 to 41, 43 to 47, 49 to 53, 55 to 57, 59 to 67 and 69 to 72 are Examples of the present invention, and Examples 6, 12, 18, 24, 30, 36, 42, 48, 54, 58 and 68 are Comparative Examples.

R52-13: 1,1,1,2,2,3,3,4,4,5,5,6,6-tridecafluorohexane tDCE: trans-1,2-dichloroethylene MeOH: methanol EtOH: ethanol IPA: 2-propanol

Examples 1 to 6

In accordance with the method described in ASTM D 92-90, the presence or absence of a flash point at 25° C., 40° C. or boiling point of the solvent composition was measured by means of a Cleveland open cup flash point tester by using the solvent composition having a composition as identified in Table 1. The results are shown in Table 1.

TABLE 1

| Examples | R52-13 (mass %) | tDCE (mass %) | MeOH (mass %) | Flash point at 25° C. | Flash point at 40° C. | Flash point at boiling point |
|---|---|---|---|---|---|---|
| 1 | 25.0 | 74.9 | 0.1 | Absent | Present | — |
| 2 | 30.0 | 66.0 | 4.0 | Absent | Absent | Absent |
| 3 | 45.6 | 49.3 | 5.1 | Absent | Absent | Absent |
| 4 | 60.0 | 34.0 | 6.0 | Absent | Absent | Absent |
| 5 | 75.0 | 15.0 | 10.0 | Absent | Absent | Absent |
| 6 | 20.0 | 79.9 | 0.1 | Present | — | — |

Examples 7 to 12

In accordance with the method described in ASTM D 92-90, the presence or absence of a flash point at 25° C., 40° C. or boiling point of the solvent composition was measured by means of a Cleveland open cup flash point tester by using the solvent composition having a composition as identified in Table 2. The results are shown in Table 2.

TABLE 2

| Examples | R52-13 (mass %) | tDCE (mass %) | EtOH (mass %) | Flash point at 25° C. | Flash point at 40° C. | Flash point at boiling point |
|---|---|---|---|---|---|---|
| 7 | 25.0 | 74.9 | 0.1 | Absent | Present | — |
| 8 | 35.0 | 63.5 | 1.5 | Absent | Absent | Absent |
| 9 | 47.5 | 49.9 | 2.6 | Absent | Absent | Absent |
| 10 | 65.0 | 31.5 | 3.5 | Absent | Absent | Absent |
| 11 | 75.0 | 15.0 | 10.0 | Absent | Absent | Absent |
| 12 | 20.0 | 79.9 | 0.1 | Present | — | — |

Examples 13 to 18

In accordance with the method described in ASTM D 92-90, the presence or absence of a flash point at 25° C., 40° C. or boiling point of the solvent composition was measured by means of a Cleveland open cup flash point tester by using the solvent composition having a composition as identified in Table 3. The results are shown in Table 3.

TABLE 3

| Examples | R52-13 (mass %) | tDCE (mass %) | IPA (mass %) | Flash point at 25° C. | Flash point at 40° C. | Flash point at boiling point |
|---|---|---|---|---|---|---|
| 13 | 25.0 | 74.9 | 0.1 | Absent | Present | — |
| 14 | 33.0 | 66.9 | 0.1 | Absent | Absent | Absent |
| 15 | 47.7 | 51.8 | 0.5 | Absent | Absent | Absent |
| 16 | 63.0 | 36.0 | 1.0 | Absent | Absent | Absent |
| 17 | 75.0 | 15.0 | 10.0 | Absent | Absent | Absent |
| 18 | 20.0 | 79.9 | 0.1 | Present | — | — |

Examples 19 to 24

A cleaning test for a metal processing oil was carried out by using the solvent composition having a composition as identified in Table 4. Namely, a test piece of SUS-304 (25 mm×30 mm×2 mm) was dipped in a metal processing oil: temper oil (manufactured by NIPPON GREASE Co., Ltd.) to have the metal processing oil deposited thereon. The test piece was taken out from the metal processing oil, and then dipped in the solvent composition which was kept at 40° C., and cleaned for five minutes with ultrasonic oscillation. Removal degree of the metal processing oil from the test piece after the cleaning was evaluated by visual observation. The results are shown in Table 4. In Table 4, ○ and X indicate well-removed, and remained, respectively.

TABLE 4

| Examples | R52-13 (mass %) | tDCE (mass %) | MeOH (mass %) | Oil removal degree |
|---|---|---|---|---|
| 19 | 25.0 | 74.9 | 0.1 | ○ |
| 20 | 30.0 | 66.0 | 4.0 | ○ |
| 21 | 45.6 | 49.3 | 5.1 | ○ |
| 22 | 60.0 | 34.0 | 6.0 | ○ |
| 23 | 75.0 | 15.0 | 10.0 | ○ |
| 24 | 80.0 | 19.9 | 0.1 | Δ |

Examples 25 to 30

A cleaning test for a metal processing oil was carried out by using the solvent composition having a composition as identified in Table 5. Namely, a test piece of SUS-304 (25 mm×30 mm×2 mm) was dipped in a metal processing oil: temper oil (manufactured by NIPPON GREASE Co., Ltd.) to have the metal processing oil deposited thereon. The test piece was taken out from the metal processing oil, and then dipped in the solvent composition which was kept at 40° C., and cleaned for five minutes with ultrasonic oscillation. Removal degree of the metal processing oil from the test piece after the cleaning was evaluated by visual observation. The results are shown in Table 5. In Table 5, ○, Δ and X indicate well-removed, slightly remained, and remained, respectively.

TABLE 5

| Examples | R52-13 (mass %) | tDCE (mass %) | EtOH (mass %) | Oil removal degree |
|---|---|---|---|---|
| 25 | 25.0 | 74.9 | 0.1 | ○ |
| 26 | 35.0 | 63.5 | 1.5 | ○ |
| 27 | 47.5 | 49.9 | 2.6 | ○ |
| 28 | 65.0 | 31.5 | 3.5 | ○ |
| 29 | 75.0 | 15.0 | 10.0 | ○ |
| 30 | 80.0 | 19.9 | 0.1 | Δ |

Examples 31 to 36

A cleaning test for a metal processing oil was carried out by using the solvent composition having a composition as identified in Table 6. Namely, a test piece of SUS-304 (25 mm×30 mm×2 mm) was dipped in a metal processing oil: temper oil (manufactured by NIPPON GREASE Co., Ltd.) to have the metal processing oil deposited thereon. The test piece was taken out from the metal processing oil, and then dipped in the solvent composition which was kept at 40° C., and cleaned for five minutes with ultrasonic oscillation. Removal degree of the metal processing oil from the test piece after the cleaning was evaluated by visual observation. The results are shown in Table 6. In Table 6, ○ and X indicate well-removed, and remained, respectively.

TABLE 6

| Examples | R52-13 (mass %) | tDCE (mass %) | IPA (mass %) | Oil removal degree |
|---|---|---|---|---|
| 31 | 25.0 | 74.9 | 0.1 | ○ |
| 32 | 33.0 | 66.9 | 0.1 | ○ |
| 33 | 47.7 | 51.8 | 0.5 | ○ |
| 34 | 63.0 | 36.0 | 1.0 | ○ |
| 35 | 75.0 | 15.0 | 10.0 | ○ |
| 36 | 80.0 | 19.9 | 0.1 | Δ |

Examples 37 to 42

A flux cleaning test was carried out by using the solvent composition having a composition as identified in Table 7. Namely, flux JS-64ND manufactured by KOKI Co., Ltd., was applied to an IPC B-25 comb electrode substrate and dried for 10 minutes at 100° C., and then, it was dipped in a molten solder bath of 260° C. for 3 seconds for soldering. After being left to stand for 24 hours at room temperature, the comb electrode substrate was dipped for 5 minutes in the solvent composition as identified in Table 7, kept at 40° C., for cleaning, whereby removal degree of flux was evaluated by visual observation. The results are shown in Table 7. In Table 7, ○, Δ and X indicate well-removed, white residue slightly remained, and white residue substantially remained, respectively.

TABLE 7

| Examples | R52-13 (mass %) | tDCE (mass %) | MeOH (mass %) | Remaining degree of white residue |
|---|---|---|---|---|
| 37 | 25.0 | 74.9 | 0.1 | ○ |
| 38 | 30.0 | 66.0 | 4.0 | ○ |
| 39 | 45.6 | 49.3 | 5.1 | ○ |
| 40 | 60.0 | 34.0 | 6.0 | ○ |
| 41 | 75.0 | 15.0 | 10.0 | ○ |
| 42 | 80.0 | 19.9 | 0.1 | X |

Examples 43 to 48

A flux cleaning test was carried out by using the solvent composition having a composition as identified in Table 8. Namely, flux JS-64ND manufactured by KOKI Co., Ltd., was applied to an IPC B-25 comb electrode substrate and dried for 10 minutes at 100° C., and then, it was dipped in a molten solder bath of 260° C. for 3 seconds for soldering. After being left to stand for 24 hours at room temperature, the comb electrode substrate was dipped for 5 minutes in the solvent composition as identified in Table 8, kept at 40° C., for cleaning, whereby removal degree of flux was evaluated by visual observation. The results are shown in Table 8. In Table 8, ○, Δ and X indicate well-removed, white residue slightly remained, and white residue substantially remained, respectively.

TABLE 8

| Examples | R52-13 (mass %) | tDCE (mass %) | EtOH (mass %) | Remaining degree of white residue |
|---|---|---|---|---|
| 43 | 25.0 | 74.9 | 0.1 | ○ |
| 44 | 35.0 | 63.5 | 1.5 | ○ |
| 45 | 47.5 | 49.9 | 2.6 | ○ |
| 46 | 65.0 | 31.5 | 3.5 | ○ |
| 47 | 75.0 | 15.0 | 10.0 | ○ |
| 48 | 80.0 | 19.9 | 0.1 | Δ |

Examples 49 to 54

A flux cleaning test was carried out by using the solvent composition having a composition as identified in Table 9. Namely, flux JS-64ND manufactured by KOKI Co., Ltd., was applied to an IPC B-25 comb electrode substrate and dried for 10 minutes at 100° C., and then, it was dipped in a molten solder bath of 260° C. for 3 seconds for soldering. After being left to stand for 24 hours at room temperature, the comb electrode substrate was dipped for 5 minutes in the solvent composition as identified in Table 9, kept at 40° C., for cleaning, whereby removal degree of flux was evaluated by visual observation. The results are shown in Table 9. In Table 9, ○, Δ and X indicate well-removed, white residue slightly remained, and white residue substantially remained, respectively.

TABLE 9

| Examples | R52-13 (mass %) | tDCE (mass %) | IPA (mass %) | Remaining degree of white residue |
|---|---|---|---|---|
| 49 | 25.0 | 74.9 | 0.1 | ○ |
| 50 | 33.0 | 66.9 | 0.1 | ○ |
| 51 | 47.7 | 51.8 | 0.5 | ○ |
| 52 | 63.0 | 36.0 | 1.0 | ○ |
| 53 | 75.0 | 15.0 | 10.0 | ○ |
| 54 | 80.0 | 19.9 | 0.1 | X |

Examples 55 to 59

20 kg of the solvent composition as identified in. Table 10 was put in an open-top type degreaser of a small size single sump type, and the degreaser was operated for 6 hours per day for 3 days. The operation condition was set so that only the composition was charged to the cleaning sump, and the composition was heated, evaporated and condensed, and then led to a water separator, and recycled to the cleaning sump, whereby the operation condition was adjusted so that the recycled amount per 1 hour would be equivalent to the amount of the charged composition. Sampling was carried out from the water separator after 18 hours of operation, and the results of the gas chromatography analysis are shown in Table 10.

TABLE 10

| Examples | Compositional ratio before operation (by mass) R52-13/tDCE/MeOH | Compositional ratio after 18 hours operation (by mass) R52-13/tDCE/MeOH |
|---|---|---|
| 55 | 30.0/66.0/4.0 | 30.6/65.2/4.2 |
| 56 | 45.6/49.3/5.1 | 45.6/49.3/5.1 |
| 57 | 60.0/34.0/6.0 | 59.4/34.9/5.7 |
| 58 | 20.0/75.0/5.0 | 23.4/61.6/5.0 |
| 59 | 70.0/28.0/2.0 | 63.8/33.4/2.8 |

Examples 60 to 64

20 kg of the solvent composition as identified in Table 11 was put in an open-top type degreaser of a small size single sump type, and the degreaser was operated for 6 hours per day for 3 days. The operation condition was set so that only the composition was charged to the cleaning sump, and the composition was heated, evaporated and condensed, and then led to a water separator, and recycled to the cleaning sump, whereby the operation condition was adjusted so that the recycled amount per 1 hour would be equivalent to the amount of the charged composition. Sampling was carried out from the water separator after 18 hours of operation, and the results of the gas chromatography analysis are shown in Table 11.

TABLE 11

| Examples | Compositional ratio before operation (by mass) R52-13/tDCE/EtOH | Compositional ratio after 18 hours operation (by mass) R52-13/tDCE/EtOH |
|---|---|---|
| 60 | 35.0/63.5/1.5 | 35.8/62.9/2.3 |
| 61 | 47.5/49.9/2.6 | 47.5/49.9/2.6 |
| 62 | 65.0/31.5/3.5 | 64.4/32.9/3.1 |
| 63 | 25.0/65.0/10.0 | 29.2/62.7/8.1 |
| 64 | 75.0/24.0/1.0 | 71.0/27.1/1.9 |

Examples 65 to 69

20 kg of the solvent composition as identified in Table 12 was put in an open-top type degreaser of a small size single sump type, and the degreaser was operated for 6 hours per day for 3 days. The operation condition was set so that only the composition was charged to the cleaning sump, and the composition was heated, evaporated and condensed, and then led to a water separator, and recycled to the cleaning sump, whereby the operation condition was adjusted so that the recycled amount per 1 hour would be equivalent to the amount of the charged composition. Sampling was carried out from the water separator after 18 hours of operation, and the results of the gas chromatography analysis are shown in Table 12.

TABLE 12

| Examples | Compositional ratio before operation (by mass) R52-13/tDCE/IPA | Compositional ratio after 18 hours operation (by mass) R52-13/tDCE/IPA |
|---|---|---|
| 65 | 33.0/66.9/0.1 | 33.6/66.1/0.3 |
| 66 | 47.7/51.8/0.5 | 47.7/51.8/0.5 |
| 67 | 63.0/36.0/1.0 | 62.4/36.8/0.8 |
| 68 | 23.0/67.0/10.0 | 25.6/66.0/8.4 |
| 69 | 73.0/25.0/2.0 | 69.9/29.0/1.1 |

Example 70

300 g of a composition of R52-13/tDCE/MeOH=45.6 mass %/49.3 mass %/5.1 mass % was put in an Othmer vapor-liquid equilibrium still, and at the time when the temperatures of the gas phase and the liquid phase became equilibrium under 1010 hPa, samples of the composition were collected from the gas phase and the liquid phase, and then their compositional ratios were measured by gas chromatography. The results are shown in Table 13.

TABLE 13

| | Gas phase compositional ratio (by mass) R52-13/tDCE/MeOH | Liquid phase compositional ratio (by mass) R52-13/tDCE/MeOH |
|---|---|---|
| Before distillation | 45.6/49.3/5.1 | 45.6/49.3/5.1 |
| After equilibrium | 45.6/49.3/5.1 | 45.6/49.3/5.1 |

Example 71

300 g of a composition of R52-13/tDCE/EtOH=47.5 mass %/49.9 mass %/2.6 mass % was put in an Othmer vapor-liquid equilibrium still, and at the time when the temperatures of the gas phase and the liquid phase became equilibrium under 1010 hPa, samples of the composition were collected from the gas phase and the liquid phase, and then their compositional ratios were measured by gas chromatography. The results are shown in Table 14.

TABLE 14

| | Gas phase compositional ratio (by mass) R52-13/tDCE/EtOH | Liquid phase compositional ratio (by mass) R52-13/tDCE/EtOH |
|---|---|---|
| Before distillation | 47.5/49.9/2.6 | 47.5/49.9/2.6 |
| After equilibrium | 47.5/49.9/2.6 | 47.5/49.9/2.6 |

Example 72

300 g of a composition of 347/tDCE/IPA=47.7 mass %/51.8 mass %/0.5 mass % was put in an Othmer vapor-liquid equilibrium still, and at the time when the temperatures of the gas phase and the liquid phase became equilibrium under 1010 hPa, samples of the composition were collected from the gas phase and the liquid phase, and then their compositional ratios were measured by gas chromatography. The results are shown in Table 15.

TABLE 15

| | Gas phase compositional ratio (by mass) R52-13/tDCE/IPA | Liquid phase compositional ratio (by mass) R52-13/tDCE/IPA |
|---|---|---|
| Before distillation | 47.7/51.8/0.5 | 47.7/51.8/0.5 |
| After equilibrium | 47.7/51.8/0.5 | 47.7/51.8/0.5 |

The solvent compositions (compositions A to G) of the present invention have a high cleaning performance against various soils and a flash point higher than room temperature. Further, compositions B, C and D are azeotrope-like solvent compositions, and compositions E, F and G are azeotropic solvent compositions. Therefore, these compositions undergo either little or no change in their compositions even if they are recycled for vapor cleaning or distillation, and their cleaning properties and various physical properties do not change. Therefore, a conventional degreaser can be used without substantial change.

INDUSTRIAL APPLICABILITY

The solvent composition of the present invention can remove oils and greases attached to articles such as electronic components, precision mechanical parts or glass substrates, or soil such as flux or dust on printed boards, etc., with a high cleaning performance.

The entire disclosure of Japanese Patent Application No. 2002-251132 filed on Aug. 29, 2002 including specification, claims and summary is incorporated herein by reference in its entirety.

What is claimed is:

1. A solvent composition comprising R52-13, tDCE and methanol, wherein the content of R52-13 is from 30.0 to 60.0% by mass, the content of tDCE is from 34.0 to 66.0% by mass and the content of methanol is from 4.0 to 6.0% by mass, to the total amount of R52-13, tDCE and methanol.

2. A method of cleaning an article, comprising applying the solvent composition of claim 1 to the article whereby the article is cleaned.

3. A solvent composition comprising R52-13, tDCE and ethanol, wherein the content of R52-13 is from 35.0 to 65.0% by mass, the content of tDCE is from 31.5 to 63.5% by mass and the content of ethanol is from 1.5 to 3.5% by mass, to the total amount of R52-13, tDCE and ethanol.

4. A method of cleaning an article, comprising applying the solvent composition of claim 3 to the article whereby the article is cleaned.

5. A solvent composition comprising R52-13, tDCE and 2- propanol, wherein the content of R52-13 is from 33.0 to 63.0% by mass, the content of tDCE is from 36.0 to 66.9% by mass and the content of 2-propanol is from 0.1 to 1.0% by mass, to the total amount of R52-13, tDCE and 2-propanol.

6. A method of cleaning an article, comprising applying the solvent composition of claim 5 to the article whereby the article is cleaned.

7. An azeotropic solvent composition comprising R52-13, tDCE and methanol, wherein the content of R52-13 is 45.6% by mass, the content of tDCE is 49.3% and the content of methanol is 5.1% by mass, to the total amount of R52-13 by mass, tDCE and methanol.

8. A method of cleaning an article, comprising applying the solvent composition of claim 7 to the article whereby the article is cleaned.

9. An azeotropic solvent composition comprising R52-13, tDCE and ethanol, wherein the content of R52-13 is 47.5% by mass, the content of tDCE is 49.9% by mass and the content of ethanol is 2.6% by mass, to the total amount of R52-13, tDCE and ethanol.

10. A method of cleaning an article, comprising applying the solvent composition of claim 9 to the article whereby the article is cleaned.

11. An azeotropic solvent composition comprising R52-13, tDCE and 2-propanol, wherein the content of R52-13 is 47.7% by mass, the content of tDCE is 51.8% by mass and the content of 2-propanol is 0.5% by mass, to the total amount of R52-13, tDCE and 2-propanol.

12. A method of cleaning an article, comprising applying the solvent composition of claim 11 to the article whereby the article is cleaned.

* * * * *